United States Patent [19]

Frankford

[11] 3,987,994

[45] Oct. 26, 1976

[54] WHEELCHAIR TABLE CLAMP

[76] Inventor: Harold F. Frankford, 611 E. Rogers St., Houston, Tex. 77022

[22] Filed: Nov. 4, 1975

[21] Appl. No.: 628,834

[52] U.S. Cl. ..... 248/226 R; 297/153

[51] Int. Cl.[2] ..... A47C 7/50; A47C 7/62

[58] Field of Search ..... 248/266 R, 226 C; 297/153, 148, DIG. 4

[56] References Cited

UNITED STATES PATENTS

| | | | |
|---|---|---|---|
| 1,003,245 | 9/1911 | Emmons | 297/153 |
| 1,060,186 | 4/1913 | Hjorth | 248/293 |
| 2,937,694 | 5/1960 | Willson et al. | 297/153 |
| 3,761,129 | 9/1973 | Schultz | 297/DIG. 4 |

*Primary Examiner*—J. Franklin Foss

[57] ABSTRACT

This device which is used in pairs, consists of a main body portion having flange means for securing by fasteners, a piece of plywood, the pair of devices being releasably secured to the wheelchair by spring-loaded lever means pivotably carried at one end, between a pair of spaced apart and extending lugs of the main body of the device.

1 Claim, 1 Drawing Figure

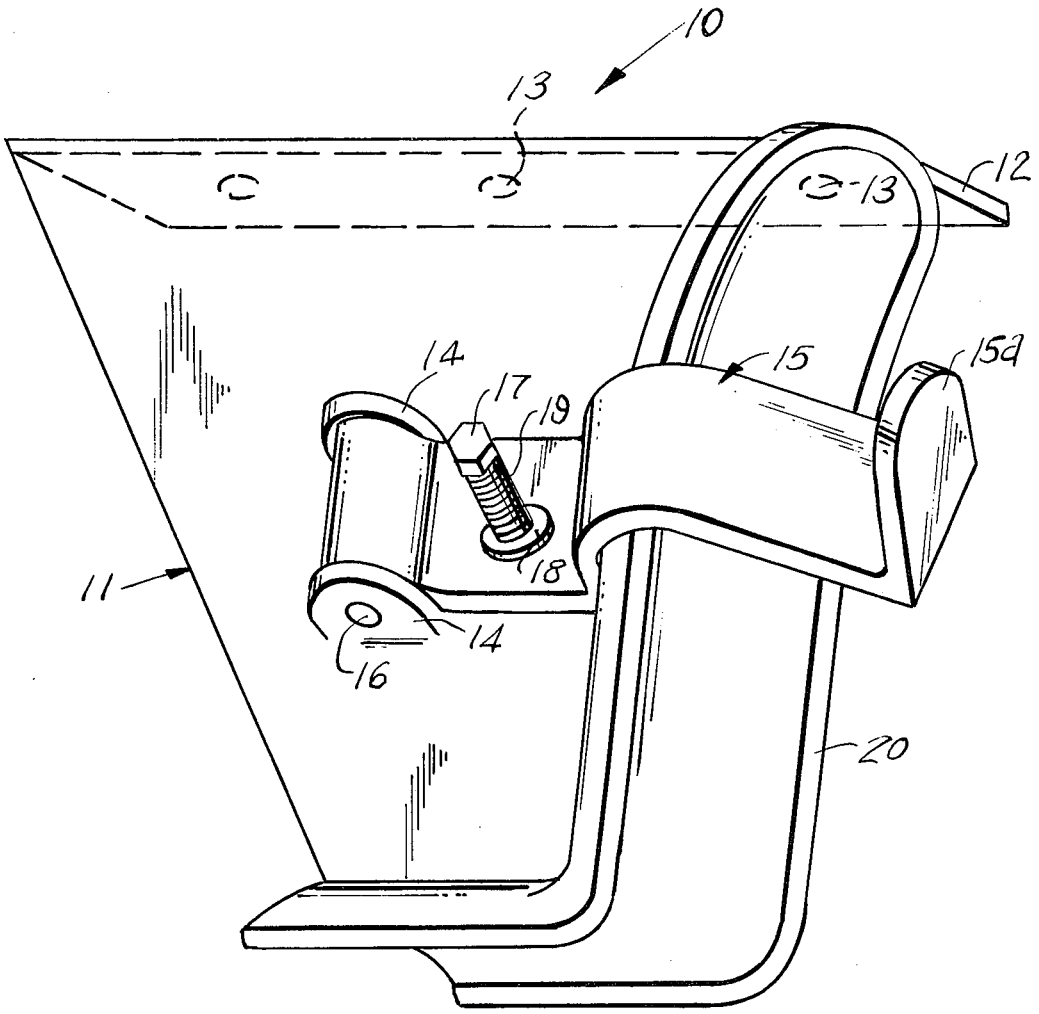
10
13
12
13
14
17
19
15
15a
18
11
14
16
20

WHEELCHAIR TABLE CLAMP

This invention relates to tables and more particularly to a wheelchair table clamp.

It is therefore the principal object of this invention to provide a wheelchair table clamp which will be used in pairs to support a plywood panel so that it may be used as table means for a person in a wheelchair.

Another object of this invention is to provide a table clamp of the type described, which will be removably received on the wheelchair and may be used as a table, a workbench, a typing table, an eating table, etc.

A further object of this invention is to provide a table clamp of the type described, which will have pivotably attached to lug means of the main body, a spring-loaded lever having lip means for manipulation.

Other objects of the invention are to provide a wheelchair table clamp, which is simple in design, inexpensive to manufacture, rugged in construction, easy to use and efficient in operation.

These and other objects will be readily evident upon a study of the following specification and the accompanying drawing which is the sole view of the present invention.

The sole FIGURE comprises a side perspective view of one of the clamps, as viewed from a level slightly below.

According to this invention, a wheelchair table clamp 10 is shown to consist of a cast aluminum main body 11 having a side flange 12. A plurality of equally spaced apart openings 13 through flange 12, provides a means for receiving suitable fasteners that will secure a plywood panel to the flange, the clamp 10 being used in pairs to support the plywood panel.

The main body 11 of each of the clamps 10, is provided with a pair of parallel spaced apart and extending lugs 14 between which is received lever 15 having lip 15*a*. Lever 15 is held pivotably between lugs 14 by means of pin 16. A bolt fastener 17 receives washer 18 and is threadably received within main body 11. A coil spring 19 urges against the underside of the head of bolt 17 at one end and urges downwards against washer 18, thus sparingly urging lever 15 towards the arcuately configurated side end 20 of main body 11, the combination forming clamp means of the table to the wheelchair.

In order to release the clamps 10 of the pair from the wheelchair, the lip 15*a* is lifted upwards against the spring 19 tension, thus releasing the arcuate side end 20 from the wheelchair.

What I claim is:

1. A pair of clamps, attachable to a wheel chair, said clamps being secured to a plywood panel forming a table top, each said clamp being comprised of a cast aluminum main body having a side flange, said flange having a plurality of equally spaced apart openings receiving fasteners securing said plywood panel to said flange of each said clamp, said main body having a pair of sidewardly extending lugs upon one side thereof, an opening in each said lug supporting a pin between said lugs, a lever pivotally supported at one end upon said pin, and opposite end of said lever extending past an arcuate side end of said main body, said opposite end of said lever being bent over to form a lip, a longitudinally intermediate portion of said lever having an opening therethrough, a bolt threadingly engaged in said main body extending sidewardly and through said opening in said longitudinally intermediate portion of said lever, a compression coil spring fitted around said bolt having one end thereof against an enlarged head formed on said bolt, an opposite end of said compression coil spring bearing against a washer, said washer being positioned against a side of said lever, whereby in order to release said clamps from said wheelchair, each said lip of said clamp levers is lifted upwardly against a tension of said compression coil spring, thus releasing said arcuate side end of said main body from said wheel chair.

* * * * *